US008720885B2

(12) United States Patent
Mizuyama

(10) Patent No.: US 8,720,885 B2
(45) Date of Patent: May 13, 2014

(54) FORM CONVEYANCE DEVICE WITH POWER TRANSFER UNIT

(71) Applicant: Seiko Epson Corporation, Tokyo (JP)

(72) Inventor: Shogo Mizuyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/793,916

(22) Filed: Mar. 11, 2013

(65) Prior Publication Data

US 2014/0035222 A1 Feb. 6, 2014

(30) Foreign Application Priority Data

Aug. 2, 2012 (JP) ..... 2012-171748

(51) Int. Cl.
*B65H 29/00* (2006.01)

(52) U.S. Cl.
USPC ..... 271/184; 271/902; 492/30

(58) Field of Classification Search
USPC ..... 271/177, 184, 207, 314, 902
See application file for complete search history.

(56) References Cited

U.S. PATENT DOCUMENTS

| | | | | |
|---|---|---|---|---|
| 2,930,611 | A * | 3/1960 | Pearce | 271/177 |
| 3,481,598 | A * | 12/1969 | Lopez | 271/184 |
| 7,243,914 | B2 * | 7/2007 | Tokunaga et al. | 271/314 |
| 7,775,517 | B2 * | 8/2010 | Ohta | 271/184 |
| 2009/0039596 | A1 | 2/2009 | Takami et al. | |

FOREIGN PATENT DOCUMENTS

| | | | | |
|---|---|---|---|---|
| JP | 61277553 | A * | 12/1986 | B65H 29/60 |
| JP | 2004-206362 | A | 7/2004 | |
| JP | 2009-040513 | A | 2/2009 | |

* cited by examiner

*Primary Examiner* — Gerald McClain

(57) ABSTRACT

A form conveyance device can reverse a form without pulling another form already stored in a storage unit into the conveyance path. A form conveyance device conveys a form on edge in forward and reverse directions and feeds the form into the storage unit. Such device includes a cylindrical support shaft, and a paper feed roller that is axially supported on the support shaft and can rotate in forward and reverse directions. Also included is an in-feed roller that is axially supported on the support shaft, can rotate only in the forward direction, and on the outside surface has in-feed tabs extending in the axial direction. A power transfer unit of the device is disposed between the paper feed roller and in-feed roller, and transfers drive power from the paper feed roller to the in-feed roller only when the paper feed roller rotates in the forward direction.

3 Claims, 4 Drawing Sheets

FORM CONVEYANCE DEVICE WITH POWER TRANSFER UNIT

CROSS-REFERENCE TO RELATED APPLICATION

Japanese Patent Application No. 20012-171748 filed on Aug. 2, 2012, is hereby incorporated by reference in its entirety.

BACKGROUND

1. Technical Field

The present invention relates to a form conveyance device used in a form processing device.

2. Related Art

One example of a form processing device used for processing slip forms is a check processing device that is used to process checks and similar forms. A typical check processing device has a supply unit in which checks to be processed are loaded, a form conveyance path to which reading/writing means such as an image scanner and magnetic head are disposed, and a check storage unit that temporarily stores the checks discharged from the conveyance path after check imaging and magnetic ink character reading processes are completed by the reading/writing means. The check forms are scanned, read, and processed while being conveyed on edge through the conveyance path by a form conveyance device, and then deposited into the check storage unit. Japanese Unexamined Patent Appl. Pub. JP-A-2004-206362 discloses an example of such a check processing device.

Form processing devices for processing forms such as described above may also convey forms in reverse for image capturing and MICR reading operations. The form processing device feeds forms into the storage unit, and reverses forms during conveyance as needed. Under certain circumstances when a form is reversed, a separate form already stored in the storage unit may be accidentally pulled back into the conveyance path with the form that is reversed intentionally. Multiple forms will overlap each other in the conveyance path when this happens, and form conveyance (feed) problems can occur.

SUMMARY

The present invention is directed to solving at least part of the foregoing problem as described below.

One aspect of the invention is a form conveyance device that conveys a form on edge in forward and reverse directions, and feeds the form into a storage unit, the form conveyance device including: a cylindrical support shaft; a paper feed roller that is axially supported on the support shaft and can rotate in forward and reverse directions; an in-feed roller that is axially supported on the support shaft, can rotate only in the forward direction, and on the outside surface has an in-feed tab extending in the axial direction; and a power transfer unit that is disposed between the paper feed roller and in-feed roller, and transfers drive power from the paper feed roller to the in-feed roller when the paper feed roller rotates in the forward direction.

When the paper feed roller is driven forward, or more specifically when a form is conveyed in the forward direction, in this aspect of the invention, the in-feed roller is also driven by drive power transferred thereto through the power transfer unit, rotates in the forward direction, and can feed the form into the storage unit. However, when the paper feed roller turns in reverse, or more specifically when a form is conveyed in the reverse direction, transferring drive power from the power transfer unit to the in-feed roller is interrupted and the in-feed roller stops. When the in-feed roller stops, an in-feed tab on the in-feed roller catches the trailing end part of any form already stored in the storage unit and stops movement of the stored form in reverse. As a result, pulling a form back into the conveyance path can be prevented, and forms can be conveyed consistently.

In a form conveyance device according to another aspect of the invention, the power transfer unit preferably includes an engaging part on the paper feed roller side that receives drive power from the paper feed roller, a ratchet part on the in-feed roller side that transfers and interrupts drive power to the in-feed roller, and an elastic part that urges the power transfer unit toward the in-feed roller. When the paper feed roller rotates in the forward direction, the ratchet part engages a ratchet engaging part on the power transfer unit side of the in-feed roller and transfers drive power. When the paper feed roller rotates in the reverse direction, the ratchet part disengages the ratchet engaging part on the power transfer unit side of the in-feed roller, idles, and interrupts the transfer of drive power.

Drive power is transferred from the paper feed roller in this aspect of the invention by the engaging part of the power transfer unit engaging the paper feed roller. The power transfer unit is also urged by the elastic part to contact the in-feed roller. When the paper feed roller turns forward, the ratchet part engages the ratchet engaging part of the in-feed roller, and transfers drive power thereto. When the paper feed roller turns in reverse, the ratchet part passes over the ratchet engaging part on the power transfer unit side of the in-feed roller in resistance to the urging force of the elastic part, and thus idles and stops transferring drive power. The in-feed roller thus assists conveying forms by the paper feed roller when the paper feed roller rotates forward, and when the paper feed roller rotates in reverse, the in-feed roller stops and an in-feed tab stops the trailing end of forms already stored in the storage unit, thereby preventing reverse conveyance of forms that were already stored in the storage unit.

Yet further preferably, the in-feed tab is formed protruding to the outside from the outside surface of the paper feed roller.

When the paper feed roller rotates forward in this aspect of the invention, an in-feed tab formed on the outside surface of the in-feed roller reliably engages the trailing end of the form conveyed in contact with the paper feed roller, and pushes the trailing end of the form fed into the storage unit to the side inside the storage unit. Because this assures a clear path for the next form fed into a specific space, the next form will not collide with the trailing end part of a form previously stored in the storage unit, and paper jams can be prevented. The in-feed tab also reliably engages the trailing end of a form stored in the storage unit when the paper feed roller turns in reverse, and pulling a stored form back into the conveyance path can be prevented.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a form conveyance device according to the present invention is described below with reference to the accompanying figures. Note that for convenience of description and illustration, the horizontal and vertical scale of members and parts of the form conveyance device may differ from their actual scale in the figures referred to below.

Figure 1A:
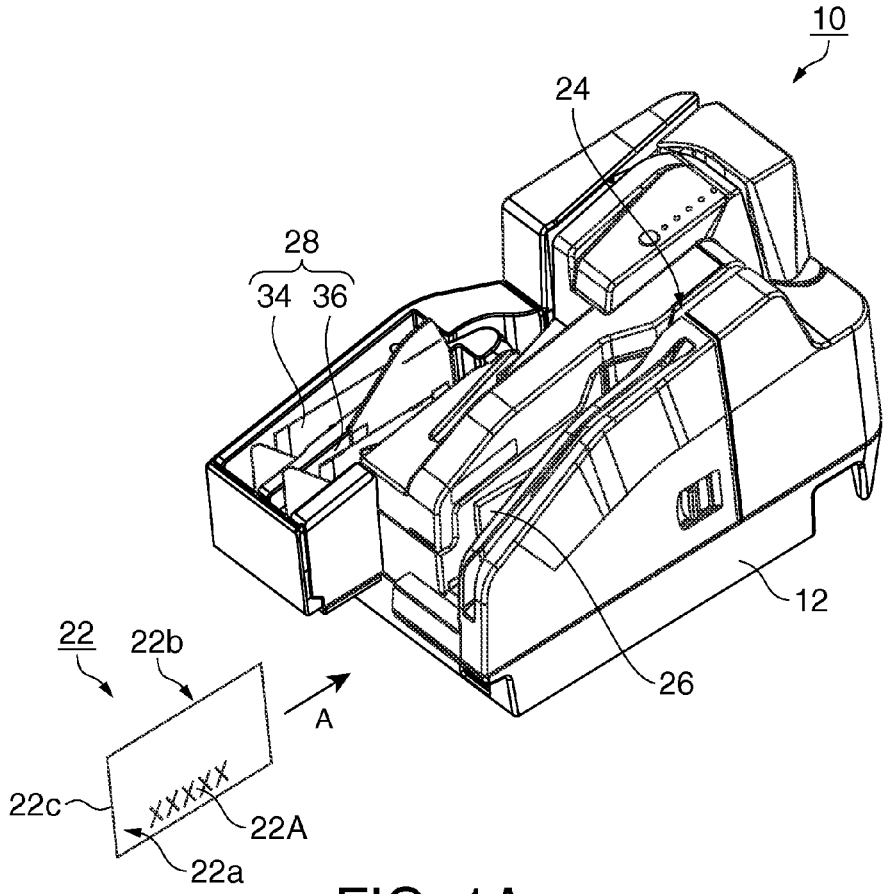
FIG. 1A is an oblique view.
Figure 1B:
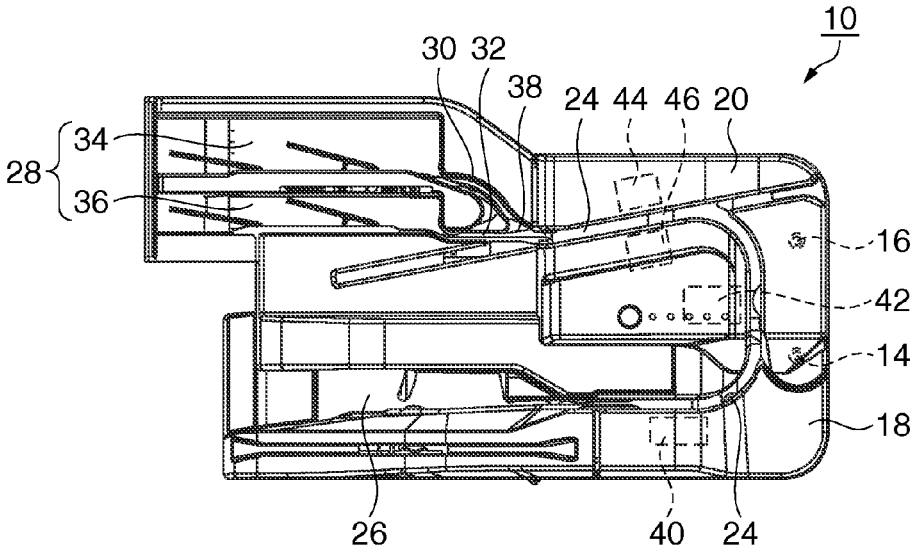
FIG. 1B is a plan view, of a check processing device described below as an example of a form processing device that uses a form conveyance device according to a preferred embodiment of the invention.

General Configuration of a Check Processing Device as an Example of a Form Processing Device The general configuration of a check processing device used as an example of a form processing device is described below. FIG. 1 is an external view of a check processing device described as an example of a form processing device using the form conveyance device according to the invention. More specifically, FIG. 1A is an external oblique view of the check processing device, and FIG. 1B is a plan view of the check processing device.

As shown in FIG. 1, the check processing device 10 has a main case 12, an access cover 18 that can open and close pivoting on a vertical pin 14 at one end of the main case 12, and another access cover 20 that pivots open and closed on another vertical pin 16. A conveyance path 24 for conveying a check 22 as an example of a processed form is formed between the main case 12 and the access covers 18 and 20.

The conveyance path 24 is a narrow vertical channel that extends curving in a basic U-shaped configuration when seen from above. A check supply unit 26 formed as a vertical channel is connected to the upstream end of the conveyance path 24 in the conveyance direction. A check storage unit 28 is connected as a storage unit to the downstream end of the conveyance path 24.

The check storage unit 28 includes a first sorting channel 30 and a second sorting channel 32, which are narrow vertical channels connected to the downstream end of the conveyance path 24; and a first pocket 34 and a second pocket 36 respectively connected to the downstream ends of the sorting channels. A flapper 38 that directs the check 22 discharged from the conveyance path 24 to the first pocket 34 or the second pocket 36 is disposed at the junction of the first sorting channel 30 and second sorting channel 32.

As shown in FIG. 1, the check 22 has an MICR line 22A printed lengthwise along the bottom part of the check face 22*a*. The check amount, payer, number, and signature are recorded against a specific background image on the check face 22*a*, and an endorsement field is provided on the back 22*b*. Plural checks 22 to be processed are placed in the check supply unit 26 with their tops and bottoms matched and the check face 22*a* facing the outside of the U-shaped conveyance path 24.

As indicated by the dotted lines in FIG. 1B, a magnetic head 40 for reading magnetic ink characters on the check 22, a printing mechanism 42 for printing information such as the bank name, date, and time on the back 22*b*, a front contact image scanner 44 for capturing an image of the check face 22*a*, and a back contact image scanner 46 for capturing an image of the back 22*b*, are disposed in order along the conveyance path 24.

As a check 22 fed from the check supply unit 26 is conveyed through the conveyance path 24, the MICR line 22A printed on the check face 22*a* is read, and the bank, date, and time when the check was processed are printed. After the face and back of the check are successfully imaged, the check 22 is stored in the first pocket 34 of the check storage unit 28. Checks 22 that cannot be read or produce a read error are stored in the second pocket 36.

Check Storage Unit

Figure 2:
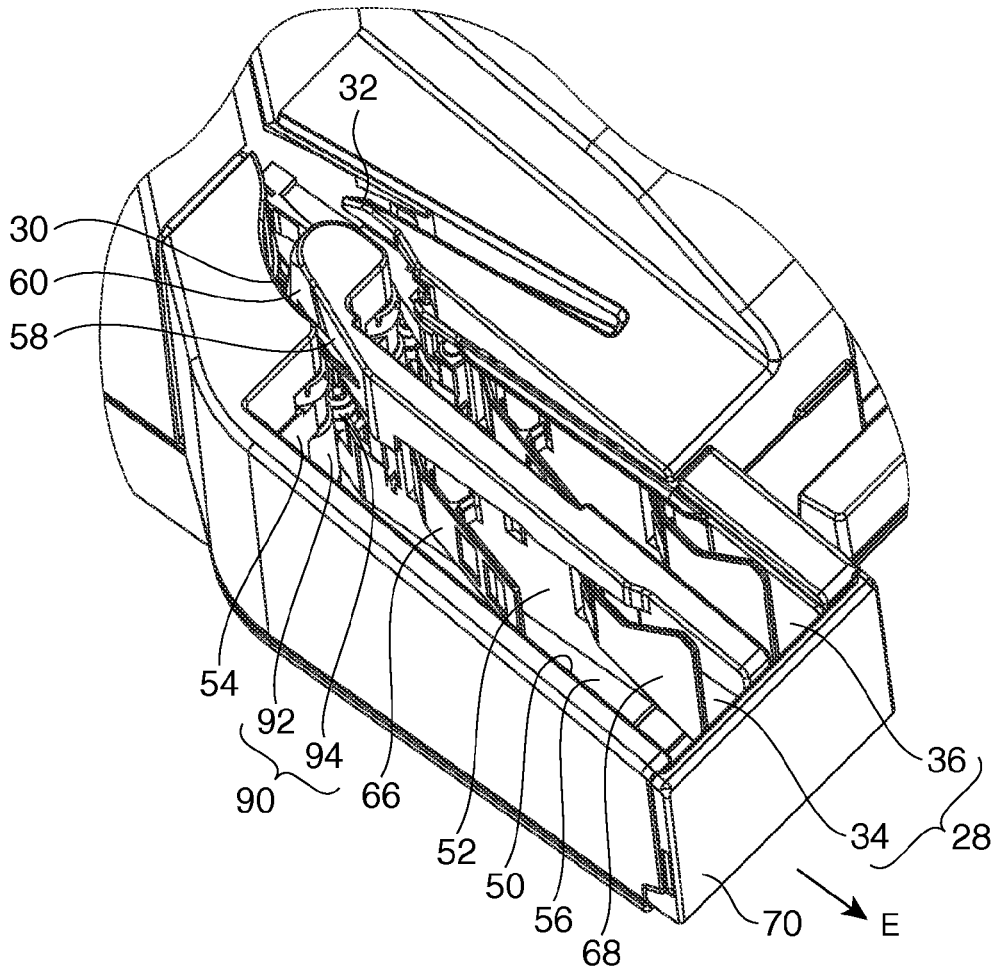
FIG. 2 is an oblique view showing the storage unit of the check processing device.

The check storage unit (storage unit) is described next with reference to FIG. 2. FIG. 2 is an oblique view showing the storage unit of the check processing device.

As shown in FIG. 2, the check storage unit 28 has a first sorting channel 30 with a first pocket 34 connected to the downstream end thereof, and a second sorting channel 32 with a second pocket 36 connected to the downstream end thereof. The first pocket 34 and second pocket 36 are identically configured, and are described below with reference to the first pocket 34. Like parts in the second pocket 36 are identified by the same reference numerals, and further description thereof is omitted.

The first pocket 34 is a vertical rectangular channel of a specific depth that is long between the front and back in the conveyance direction, and includes a first side wall 50 and parallel second side wall 52 on the left and right sides as seen in the figure, an end wall 54, and a bottom 56. A diagonal guide surface 58 that faces the end wall 54 is formed from the upstream end of the second side wall 52 at an angle that opens away from the first side wall 50. The upstream side of this inclined guide surface 58 continues to one inside wall 60 of the first sorting channel 30.

A form conveyance device 90 for feeding the check 22 into the first pocket 34 is disposed beside the end wall 54 on the inclined guide surface 58 side. The form conveyance device 90 includes a conveyance roller 92 and a pressure roller 94. The pressure roller 94 pushes the check 22 against the conveyance roller 92, and protrudes from the one inside wall 60 of the first sorting channel 30 opposite the conveyance roller 92. Two vertical pressure plates 66, 68 that incline at a specific angle to the downstream side from the second side wall 52 to the first side wall 50 are also disposed inside the first pocket 34.

A check 22 fed from the upstream side into the first pocket 34 by the conveyance roller 92 and pressure roller 94 is guided by the inclined guide surface 58 so that the leading end approaches the first side wall 50 while advancing into the first pocket 34. The in-fed check 22 is also pushed to the first side wall 50 side by the vertical pressure plates 66, 68, and stored in a horizontal stack.

The downstream ends of the first pocket 34 and second pocket 36 of the check storage unit 28 in this embodiment are defined by an adjustable stop 70 that can be pulled out to the front in the direction of arrow E. Pulling this adjustable stop 70 out in the direction of arrow E shown in FIG. 2 from the position shown in FIG. 1 lengthens the first pocket 34 and second pocket 36 in the direction of arrow E. This enables receiving and storing long checks 22.

Form Conveyance Device

Figure 3A:
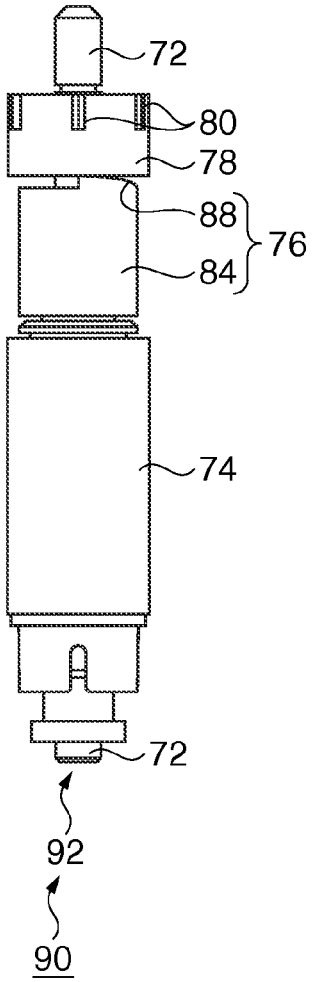
FIG. 3A and FIG. 3B show a conveyance roller of the form conveyance device.
Figure 3B:
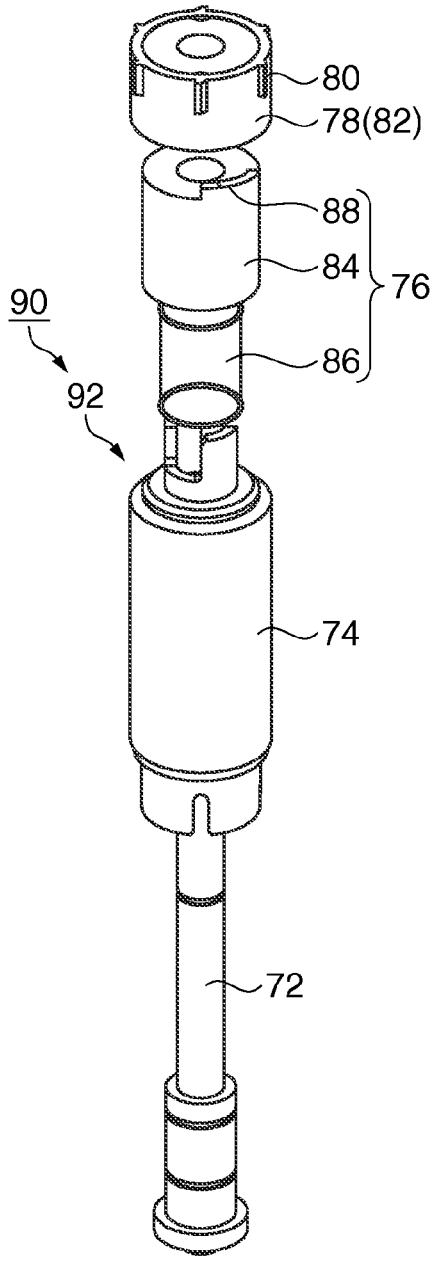

The form conveyance device according to this embodiment of the invention is described next with reference to FIG. 3A, FIG. 3B, and FIG. 4A, FIG. 4B. FIG. 3A is a side view of a conveyance roller, and FIG. 3B is a partially exploded oblique view of the conveyance roller.

The form conveyance device 90 includes a conveyance roller 92 and pressure roller 94 as described above. As shown in FIG. 3A and FIG. 3B, the conveyance roller 92 includes a cylindrical support shaft 72, paper feed roller 74, power transfer unit 76, and in-feed roller 78. The paper feed roller 74 is a cylindrical roller with, for example, a rubber coating on the outside, and is supported by the support shaft 72. The paper feed roller 74 receives drive power from a paper feed motor not shown, and can rotate in both forward and reverse directions.

The power transfer unit 76 is disposed between the paper feed roller 74 and the in-feed roller 78 described below, and functions to selectively transfer drive power from the paper feed roller 74 to the in-feed roller 78. The power transfer unit 76 includes an engaging part 84, an elastic part 86, and a ratchet part 88.

The engaging part 84 is cylindrical and made of a desirable material such as plastic, and has a ratchet part 88 formed on the top. The engaging part 84 is supported freely rotatably on the support shaft 72, rotates in conjunction with the paper feed roller 74, and can slide axially along the support shaft 72. The elastic part 86, which is typically a compression spring, is placed inside the engaging part 84. The elastic part 86 urges the engaging part 84 toward the in-feed roller 78.

The in-feed roller 78 is cylindrical and made of a desirable material such as plastic, and on the outside surface has a plurality of feed tabs 80 that extend in the axial direction and protrude in the normal direction. The in-feed roller 78 is supported freely rotatably on the support shaft 72, has an internal one-way clutch 82, and can rotate only forward. A protruding tab not shown that engages the ratchet part 88 described above is disposed on the bottom of the in-feed roller 78.

When the paper feed roller 74 is driven forward, the ratchet part 88 of the engaging part 84 engages the in-feed roller 78, and drive power is transferred from the paper feed roller 74 to the in-feed roller 78. When the paper feed roller 74 is driven in reverse, the in-feed roller 78 is stopped by the one-way clutch 82, the engaging part 84 slides axially and the ratchet part 88 disengages, and drive power from the paper feed roller 74 is interrupted. More specifically, both the paper feed roller 74 and in-feed roller 78 rotate in the forward direction when the conveyance roller 92 rotates forward, but when the conveyance roller 92 rotates in reverse, the in-feed roller 78 stops turning and only the paper feed roller 74 turns in reverse.

The pressure roller 94 is a cylindrical roller with, for example, a rubber coating on the outside, and is pressed with specific pressure to the outside of the paper feed roller 74. The pressure roller 94 and paper feed roller 74 hold a check 22 therebetween, and convey the check 22 forward or reverse in conjunction with rotation of the paper feed roller 74.

Forward and Reverse Feeding a Check in the Storage Unit

The check feed operation in the storage unit is described next with reference to FIG. 4. FIG. 4A and FIG. 4B describe conveying a check forward and in reverse, FIG. 4A being a plan view showing the storage unit during forward conveyance, and FIG. 4B being a plan view showing the storage unit during reverse conveyance.

A check 22 that has been imaged on the front and back sides in the check processing device 10 is conveyed forward (in the direction of arrow A) by the form conveyance device 90 and delivered into the first pocket 34 of the check storage unit 28. At this time the check 22 is held between the paper feed roller 74 and pressure roller 94 of the form conveyance device 90, and conveyed in the forward direction A by the forward rotation of the paper feed roller 74 (in the direction of arrow C). The in-feed roller 78 rotates synchronized to rotation of the paper feed roller 74, and assists conveying the check 22 in the forward direction A.

Figure 4A:
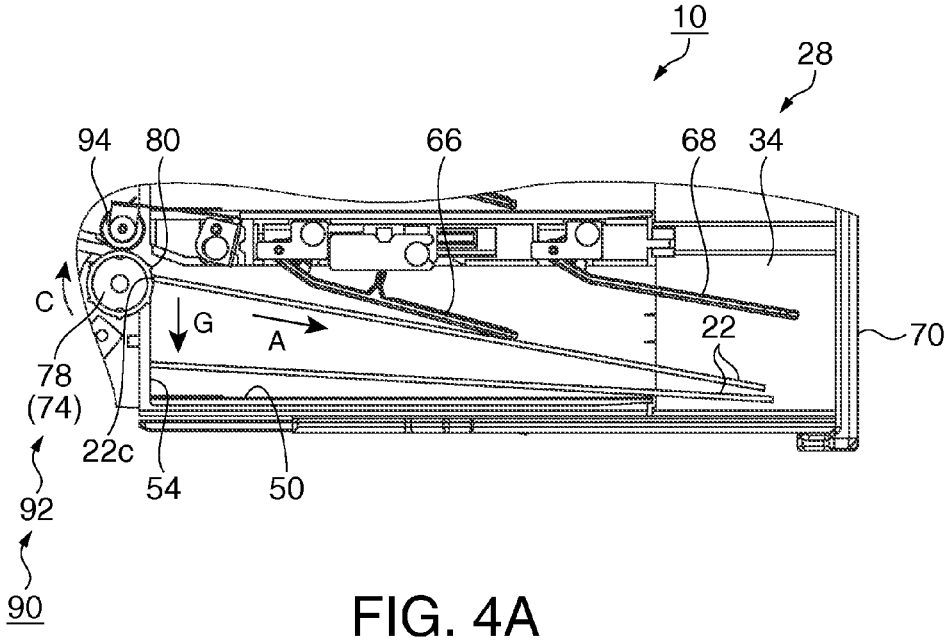
FIG. 4A and FIG. 4B describe forward and reverse conveyance of a form.

When the check 22 is conveyed forward and the trailing end of the check 22 reaches the form conveyance device 90 as shown in FIG. 4A, the feed tabs 80 on the in-feed roller 78 engage the trailing end 22*c* of the conveyed check 22. The feed tabs 80 then kick the trailing end 22*c* of the check 22 in the direction of arrow G in FIG. 4A, and move the check 22 to the first side wall 50 side of the first pocket 34. This assures a clear path for the next check 22 fed into the first pocket 34. The next check 22 is similarly moved to the first side wall 50 side of the first pocket 34, and stored in a stack with the other checks.

When the front and back sides of a check 22 are scanned in the check processing device 10 described above but the scan is no good or a reading error occurs, the check 22 may be stored in the second pocket 36 or scanned again depending on the degree of the problem. The problem checks 22 deposited in the second pocket 36 are removed and reviewed by the user in batches. The problem may then be corrected and the checks 22 reprocessed by the check processing device 10. Scanning problems and reading errors can result from the check 22 being inserted upside down or backwards, or being soiled, for example.

When a check 22 is processed by the check processing device 10 but part of the check could not be scanned or read correctly, the form conveyance device 90 can reverse the check (in the direction of arrow B) and repeat the process.

Figure 4B:
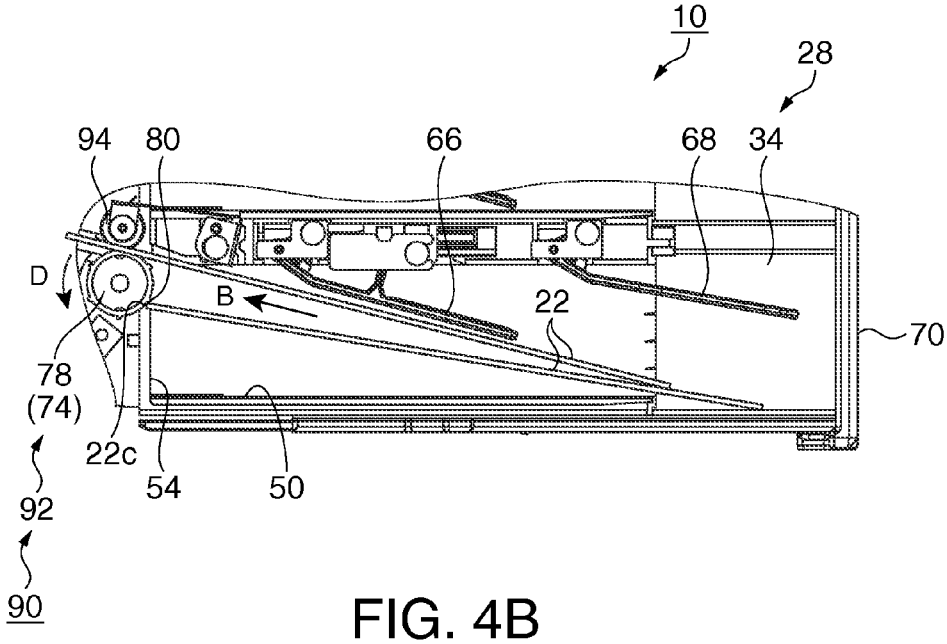

As shown in FIG. 4B, when the paper feed roller 74 rotates in reverse (in the direction of arrow D), the in-feed roller 78 is stopped by the one-way clutch 82 as described above, the ratchet part 88 disengages, and drive power from the paper feed roller 74 is interrupted. As a result, the in-feed roller 78 can be held without turning.

When a scanning error occurs, the check 22 is held nipped between the paper feed roller 74 and pressure roller 94, conveyed in reverse in conjunction with rotation of the paper feed roller 74 in the direction of arrow D, and the scanning process repeats. A check 22 that was already stored in the check storage unit 28 could be reversed together with the problem check 22 at this time. However, the feed tabs 80 of the in-feed roller 78 catch the trailing end 22*c* part of the check 22 stored in the check storage unit 28. As a result, a check 22 stored in the check storage unit 28 can be prevented from being pulled back into the conveyance path 24 in conjunction with movement of the check 22 that is reversed.

The effect of this embodiment of the invention is described below.

The form conveyance device 90 of the check processing device 10 described above has a paper feed roller 74 that can rotate in forward and reverse directions, and an in-feed roller 78 that has feed tabs 80 and can only rotate forward. As a result, when a form (check 22) is conveyed forward, the check 22 can be conveyed by the paper feed roller 74 and the in-feed roller 78. At the same time, the feed tabs 80 disposed to the outside surface of the paper feed roller 74 can kick the trailing end 22*c* of the check 22 and store the check 22 in the corresponding storage pocket of the check storage unit 28. As a result, a clear path can be assured for the next check 22 fed into the check storage unit 28.

When the form (check 22) is reversed, only the paper feed roller 74 turns in reverse while the in-feed roller 78 is stopped and held stationary. The in-feed roller 78 also has the feed tabs 80 on the outside surface. As a result, the check 22 that is intended to be conveyed can be conveyed in reverse, and the trailing end 22*c* of a check 22 already stored in the check storage unit 28 can be caught and stopped by the feed tabs 80. As a result, a check 22 stored in the check storage unit 28 can be prevented from being pulled back into the conveyance path 24 in conjunction with movement of a check 22 that is being reversed. Stable check 22 conveyance is therefore possible.

A preferred embodiment of the invention is described above, but the invention is not so limited and can be varied in many ways without departing from the scope of the accompanying claims. An example of such variations is described below.

Variation 1

The foregoing embodiment describes a configuration having a form conveyance device 90 with an in-feed roller 78 that can only rotate in the forward direction disposed as a reversing prevention stopper at the end of the conveyance path 24, that is, before the check storage unit 28, but the invention is not so limited. If the form conveyance device 90 is located at the check supply unit 26, a form that has once been fed into the conveyance path 24 can be prevented from returning to the check supply unit 26 and colliding with another check 22 waiting in the check supply unit 26.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A form conveyance device that conveys a form and feeds the form into a storage unit, the form conveyance device comprising:

a cylindrical support shaft;

a paper feed roller that is axially supported on the support shaft and rotates in forward and reverse directions to convey a form on edge in the forward and reverse directions;

an in-feed roller that is axially supported on the support shaft, can rotate only in the forward direction, and on the outside surface has an in-feed tab extending in the axial direction; and a power transfer unit that is disposed between the paper feed roller and in-feed roller, and transfers drive power from the paper feed roller to the in-feed roller when the paper feed roller rotates in the forward direction.

2. The form conveyance device described in claim 1, wherein:

the power transfer unit includes an engaging part on the paper feed roller side that receives drive power from the paper feed roller, a ratchet part on the in-feed roller side that transfers and interrupts drive power to the in-feed roller, and an elastic part that urges the power transfer unit toward the in-feed roller;

the ratchet part engages the in-feed roller and transfers drive power to the in-feed roller when the paper feed roller rotates in the forward direction, and when the paper feed roller rotates in the reverse direction, the ratchet part disengages from the in-feed roller, idles, and interrupts the transfer of drive power to the in-feed roller.

3. The form conveyance device described in claim 1, wherein:

the in-feed tab is formed protruding to the outside from the outside surface of the paper feed roller.

* * * * *